US012298008B2

(12) United States Patent
Hu

(10) Patent No.: US 12,298,008 B2
(45) Date of Patent: May 13, 2025

(54) FUEL SYSTEM WITH RADIALLY ARRANGED INJECTORS FOR HYDROGEN-DRIVEN GAS TURBINE ENGINE

(71) Applicant: PRATT & WHITNEY CANADA CORP., Longueuil (CA)

(72) Inventor: Tin Cheung John Hu, Markham (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 18/425,080

(22) Filed: Jan. 29, 2024

(65) Prior Publication Data

US 2024/0263796 A1 Aug. 8, 2024

Related U.S. Application Data

(60) Provisional application No. 63/482,854, filed on Feb. 2, 2023.

(51) Int. Cl.
*F23R 3/28* (2006.01)
*F23R 3/00* (2006.01)

(52) U.S. Cl.
CPC ..... *F23R 3/286* (2013.01); *F23R 3/002* (2013.01); *F23R 3/283* (2013.01)

(58) Field of Classification Search
CPC ..... F23R 3/343
See application file for complete search history.

(56) References Cited

U.S. PATENT DOCUMENTS

| | | | | |
|---|---|---|---|---|
| 5,303,542 | A * | 4/1994 | Hoffa | F02C 9/34 60/773 |
| 5,682,747 | A * | 11/1997 | Brown | F23R 3/10 60/746 |
| 6,474,070 | B1 | 11/2002 | Danis et al. | |
| 9,719,419 | B2 | 8/2017 | Sometani et al. | |
| 10,465,909 | B2 * | 11/2019 | Boardman | F23R 3/286 |
| 11,480,337 | B2 | 10/2022 | Prociw et al. | |
| 2005/0188703 | A1 | 9/2005 | Sprouse et al. | |
| 2013/0219897 | A1 | 8/2013 | Nakamura et al. | |
| 2017/0211807 | A1 * | 7/2017 | Graichen | F23R 3/283 |
| 2018/0094817 | A1 * | 4/2018 | Proscia | F23R 3/346 |
| 2022/0099299 | A1 | 3/2022 | Carrotte et al. | |
| 2023/0003385 | A1 * | 1/2023 | Naik | F23R 3/04 |
| 2023/0392557 | A1 * | 12/2023 | Bulat | F23R 3/36 |

FOREIGN PATENT DOCUMENTS

| | | |
|---|---|---|
| EP | 0780631 | 6/1997 |
| WO | 2018144008 | 8/2018 |

OTHER PUBLICATIONS

European Search Report for European Patent Application No. 24154259.6 mailed May 15, 2024.

* cited by examiner

*Primary Examiner* — David P. Olynick
(74) *Attorney, Agent, or Firm* — Carlson, Gaskey & Olds, P.C.

(57) ABSTRACT

A gas turbine engine includes a combustion chamber and groups of injectors for introducing a hydrogen and gas mixture into the combustion chamber. Each group of injectors includes radially inner, outer, and intermediate injectors, and each injector includes a hydrogen feed conduit that has an open-cell metallic foam disposed therein.

17 Claims, 3 Drawing Sheets

FUEL SYSTEM WITH RADIALLY ARRANGED INJECTORS FOR HYDROGEN-DRIVEN GAS TURBINE ENGINE

BACKGROUND

A gas turbine engine typically includes a fan section, a compressor section, a combustor section and a turbine section. Air entering the compressor section is compressed and delivered into the combustion section where it is mixed with fuel and ignited to generate a high-pressure and temperature exhaust gas flow. The high-pressure and temperature exhaust gas flow expands through the turbine section to drive the compressor and the fan section. The compressor section may include low and high pressure compressors, and the turbine section may also include low and high pressure turbines.

Present gas turbine engines use liquid hydrocarbon fuels (LHF). LHF is provided through a fuel supply system and introduced into the combustor by liquid injectors. The fuel supply system and liquid injectors are designed for handling and efficient burning of the LHF. For instance, as liquid is much denser than the air (gas) it is to be mixed with, it is necessary for the liquid injectors to atomize the LHF into tiny droplets in order to facilitate more uniform burning. More recently it has been proposed to utilize hydrogen ($H_2$) as a fuel.

SUMMARY

A gas turbine engine according to an example of the present disclosure includes a combustion chamber and groups of injectors for introducing a hydrogen and gas mixture into the combustion chamber. Each group of injectors includes radially inner, outer, and intermediate injectors, and each injector includes a hydrogen feed conduit that has an open-cell metallic foam disposed therein.

The present disclosure may include any one or more of the individual features disclosed above and/or below alone or in any combination thereof.

BRIEF DESCRIPTION OF THE DRAWINGS

The various features and advantages of the present disclosure will become apparent to those skilled in the art from the following detailed description. The drawings that accompany the detailed description can be briefly described as follows.

In this disclosure, like reference numerals designate like elements where appropriate and reference numerals with the addition of one-hundred or multiples thereof designate modified elements that are understood to incorporate the same features and benefits of the corresponding elements.

DETAILED DESCRIPTION

Figure 1:
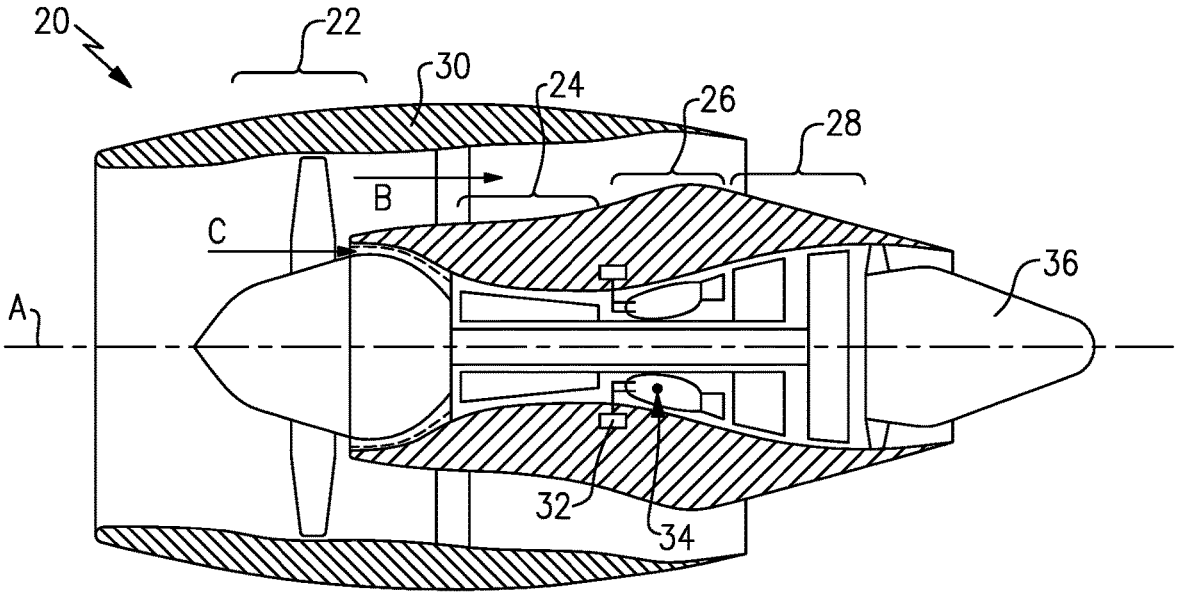
FIG. 1 illustrates a gas turbine engine.

FIG. 1 schematically illustrates a gas turbine engine 20. The example gas turbine engine 20 is a turbofan that generally incorporates a fan section 22, a compressor section 24, a combustor section 26, and a turbine section 28. The fan section 22 drives air along a bypass flow path B in a bypass duct defined within a nacelle 30. The turbine engine 20 intakes air along a core flow path C into the compressor section 24 for compression and communication into the combustor section 26. In the combustor section 26, the compressed air or other combustion gas is mixed with fuel from a fuel system 32 and ignited by igniter 34 to generate an exhaust gas flow that expands through the turbine section 28 and is exhausted through exhaust nozzle 36. Although depicted as a turbofan turbine engine in the disclosed non-limiting embodiment, it should be understood that the concepts described herein are not limited to use with turbofans as the teachings may be applied to other types of turbine engines. As one example, rather than having the propulsor be an enclosed fan, the propulsor may be an open propeller.

While present gas turbine engines use liquid hydrocarbon fuels (LHF), the engine 20 of the present disclosure is designed to use gaseous fuel, such as hydrogen, in the fuel system 32. In this regard, the fuel system 32 may carry liquid cryogenic hydrogen or gaseous hydrogen, both of which are provided to the combustor section 26 as gaseous hydrogen. A challenge to using hydrogen is that because it is a gas, its handling and combustion properties differ from that of LHF. For instance, hydrogen does not require atomization like a liquid, and hydrogen has higher flammability and different flame characteristics than LHF. Accordingly, injector nozzles and combustors that are designed for hydrogen are needed. In these regards, the engine 20 includes a combustion system 38 that is configured for introducing the hydrogen fuel into the combustor section 26.

Figure 2:
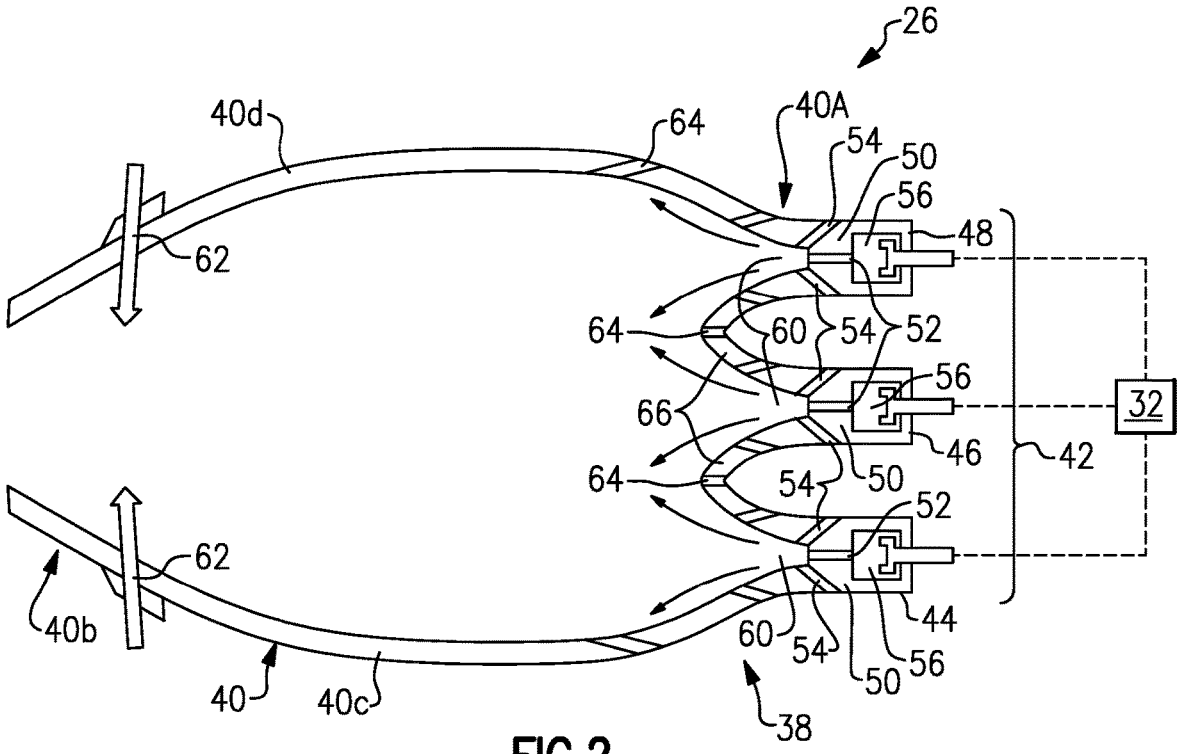
FIG. 2 illustrates the combustor section of the engine.

FIG. 2 shows a sectioned view of the combustion system 38 taken along a radial plane that includes the engine axis A. The combustion system 38 includes an annular combustion chamber 40 in the combustor section 26 for introducing hydrogen and combustion gas (e.g., air in the examples herein). The combustion chamber 40 is annularly disposed about the engine axis A and has first and second axial ends 40*a*/40*b* and radially inner and outer walls 40*c*/40*d*. Radially "inner" and "outer" as used herein indicate radial proximity to the engine axis A.

There are groups 42 (one representative group shown) of injectors at the first axial end 40*a* that are connected to the fuel system 32 (hydrogen source) and the compressor section 24 for introducing a hydrogen and air mixture into the combustion chamber 40. The groups 42 are circumferentially arranged about the engine axis A. Each group 42 has three radially-arranged injectors, which include radially inner, intermediate, and outer injectors 44/46/48.

Each injector 44/46/48 includes an injector body 50 that defines one or more hydrogen feed conduits 52 and one or more air feed conduits 54. In general, the size (at the conduit exits) of all of the hydrogen feed conduits 52 are equivalent, and the size (at the conduit exit) of all of the air feed conduits 54 are equivalent, although the sizes may differ between the hydrogen feed conduits 52 and the air feed conduits 54. Each of the hydrogen feed conduits 52 includes an open-cell metallic foam 56 disposed therein. The foam 56 serves as a flame arrestor, allowing feed flow of hydrogen but facilitating the prevention of flame propagation back through the injector 44/46/48 For instance, the open-cell metallic foam 56 is formed of an alloy that has low susceptibility to hydrogen embrittlement, such as but not limited to, stainless steel or nickel alloy, and which is corrosion resistant and temperature resistant at the expected operating conditions. A "conduit" as used herein is defined by one or more structures that together convey a fluid from one point to another. For example, a conduit conveying fluid from point A to point B may include one of, or a combination of: a tube, an aperture defined through a part of an engine, a filter, a pump, and so on, depending on the application and context as would be understood by a person of ordinary skill in the art reading the present disclosure.

Figure 3:
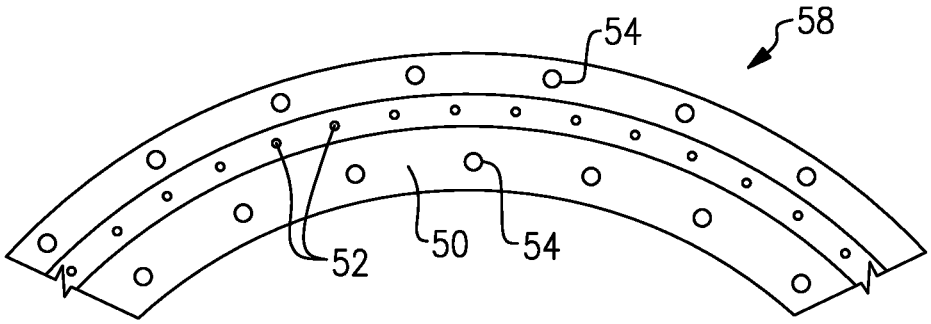
FIG. 3 illustrates an arc section of an annular injector.

Each of the injectors 44/46/48 is an annular injector 58, a representative example arc section of which is shown in axial view in FIG. 3. In this regard, the injector body 50 is a circular band through which the conduits 52/54 extend. The conduits 52/54 may be angled radially and axially to provide a swirling flow into a mixing region 60 (FIG. 2) where the air and hydrogen mix prior to injection into the combustion chamber 40.

In the example of FIG. 2, the intermediate injector 46 is a pilot injector for introducing a first percentage of the hydrogen and air mixture into the combustion chamber 40, and the radially inner and outer injectors 44/48 are main injectors for introducing a second percentage of the hydrogen and air mixture into the combustion chamber. In general, the pilot injector 46 is used for engine starting, flame stability, and power level controls. In these regards, the percentage of the hydrogen and air mixture provided by the pilot injector 46 versus the percentage provided by the main injectors 44/48 may be adjusted based on engine performance. The stoichiometric ratios of the hydrogen and air in the mixtures provided by the pilot injector 46 and the main injectors 44/48 may also be adjusted for further control over engine performance. For example, an engine controller may control the percentage and ratios in accordance with a control schedule, such as a lookup table. At starting, idle and low power conditions, the intermediate injector 46 will be flowing the pilot fuel at the center of the combustor. During acceleration to the approach condition (30% power level), the main injectors 44/48 will come on following a transition fuel schedule to supplement power to the engine. The stoichiometry in each mixing region 60 immediately downstream of the pilot and main injectors 46/48/44 is optimized for combustion efficiency and minimized for NOx emission. The fuel system 32 may include valves, flow meters, and other known flow control devices that are configured to be operated by the controller in response to the control schedule to control flow of hydrogen and air. The combustion system 38 may further include a plurality of trimming or dilution jets 62 axially downstream from the injectors 44/46/48 for further controlling and the combustor radial flame temperature exit profile. There can be 10%-20% of the air for the combustor be entering through the jets 62.

The axial location and the radial orientation of each main injector 44/48 and its injector body 50 can be optimized for flame stability, combustion efficiency, liner durability and minimal NOx emission.

The outer main injector 48 may be arranged to have a higher fuel-air ratio than the inner main injector 44, hence exhausting with a higher gas temperature at the tip than the root of the turbine blades downstream. Such setting of the fuel-air mixture ratio across the outer, intermediate and inner fuel injectors can be optimized for turbine efficiency and hot section durability.

The combustion chamber 40 may also include cooling jets 64 for introducing additional air for combustion and cooling the walls of the chamber 40. Some of the cooling jets 64 are located in conical fairings 66 located radially between, respectively, the inner and intermediate injectors 44/46 and the outer and intermediate injectors 48/46. The fairings 66 bound a radial portion of the mixing region 60 and facilitate downstream flow of the hydrogen and air mixture into the combustion chamber 40. For example, the groups 42 of injectors introduce 70% to 80% of the air through the passages 54 for combustion into the combustion chamber 40, and the cooling jets 64 introduce 10% to 20% of the air for combustion into the combustion chamber 40. Such percentages enable a lean burn of the hydrogen, which also facilitates low NOx emissions.

Figure 4:
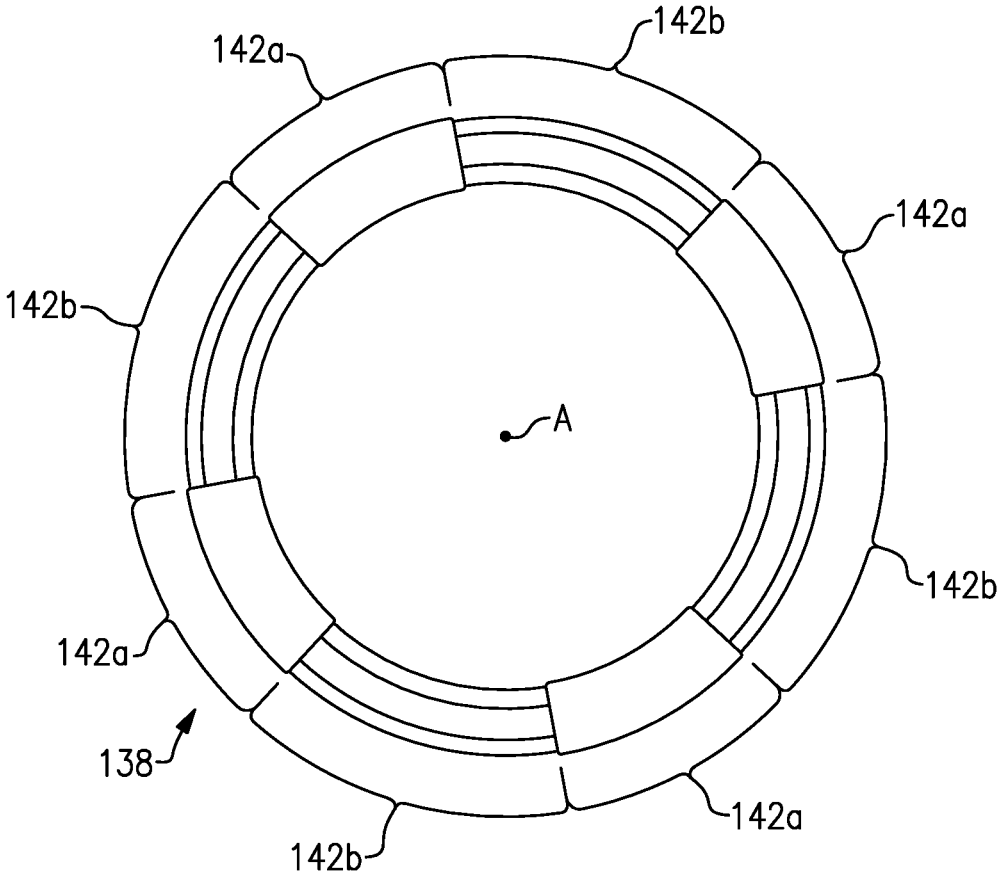
FIG. 4 illustrates an axial view pilot and main injector groups.
Figure 5:
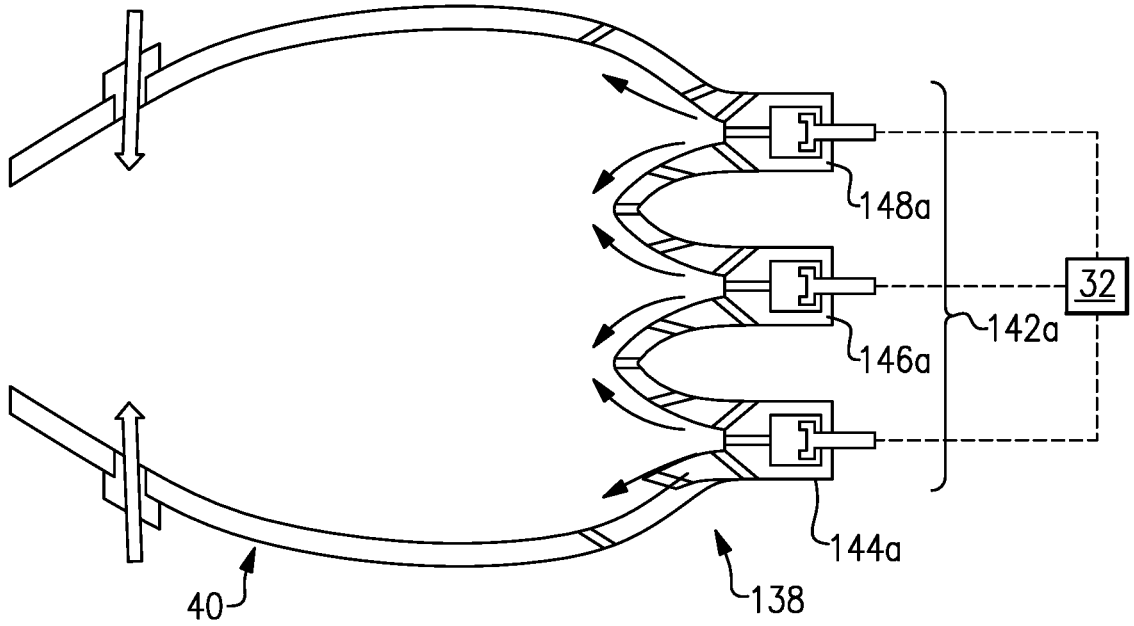
FIG. 5 illustrates a group of pilot injectors.
Figure 6:
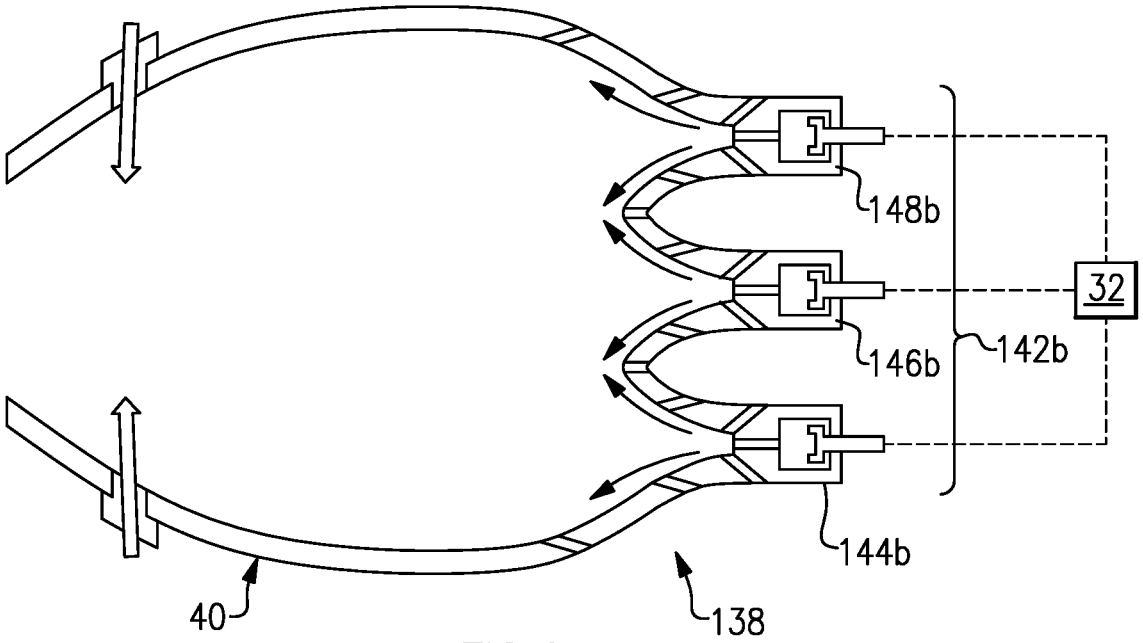
FIG. 6 illustrates a group of main injectors.

FIG. 4 illustrates another example of a combustion system 138. In this example, the system 138 includes groups 142*a*/142*b* of injectors arranged about the engine axis A. As shown in FIG. 5, each of the groups 142*a* includes injectors 144*a*/146*a*/148*a*, and as shown in FIG. 6 each of the groups 142*b* includes injectors 144*b*/146*b*/148*b*. Each group 142*a*/142*b* is analogous to the aforementioned group 42 except that the injectors 144*a*/146*a*/148*a* of the group 142*a* are all pilot injectors for introducing a first percentage of the hydrogen and air mixture into the combustion chamber 40 and the injectors 144*b*/146*b*/148*b* of the group 142*b* are all main injectors for introducing a second percentage of the hydrogen and air mixture into the combustion chamber 40. The groups 142*a*/142*b* circumferentially alternate such that each of the pilot groups 142*a* is circumferentially between two of the main groups 142*b* and each of the main groups 142*b* is circumferentially between two of the pilot groups 142*a*. In these regards, the pilot groups 142*a* each have first arc length (L1) about the axis A, the main groups 142*b* each have a second arc length (L2) about the axis, and the first arc length L1 is different than, such as smaller than, the second arc length L2.

This disclosure may be further understood in view of the following examples. A turbine engine 20 according to an example of the present disclosure includes a combustion chamber 40 disposed about an axis A and having first and second axial ends 40*a*/40*b* and radially inner and outer walls 40*c*/40*d*. Groups 42 of injectors 44/46/48 are disposed about the axis A at the first axial end 40*a* for introducing a hydrogen and gas mixture into the combustion chamber 40. Each of the groups 42 includes radially inner, outer, and intermediate injectors 44/46/48. Each of the injectors 44/46/48 has a hydrogen feed conduit 52 including an open-cell metallic foam 56 disposed therein.

In a further example of the foregoing example, the intermediate injector 46 is a pilot injector for introducing a first percentage of the hydrogen and gas mixture into the combustion chamber 40.

In a further example of any of the foregoing examples, the radially inner and outer injectors 44/48 are main injectors for introducing a second percentage of the hydrogen and gas mixture into the combustion chamber 40.

In a further example of any of the foregoing examples, the combustion chamber 40 includes first and second conical fairings 66 radially between, respectively, the inner and intermediate injectors 44/46 and the outer and intermediate injectors 48/46.

In a further example of any of the foregoing examples, the first and second conical fairings 66 include cooling jets 64.

In a further example of any of the foregoing examples, the groups include pilot groups 142*a* in which the injectors are pilot injectors 144*a*/146*a*/148*a* for introducing a first percentage of the hydrogen and gas mixture into the combustion chamber 40.

In a further example of any of the foregoing examples, the groups include main groups 142*b* in which the injectors are main injectors 144*b*/146*b*/148*b* for introducing a second percentage of the hydrogen and gas mixture into the combustion chamber 40.

In a further example of any of the foregoing examples, the pilot groups and the main groups 142*a*/142*b* circumferentially alternate such that each of the pilot groups 142*a* is circumferentially between two of the main groups 142*b* and each of the main groups 142*b* is circumferentially between two of the pilot groups 142*a*.

In a further example of any of the foregoing examples, the pilot groups 142*a* each have first arc length L1 about the axis A, the main groups 142*b* each have a second arc length L2 about the axis A, and the first arc length L1 is smaller than the second arc length L2.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A gas turbine engine comprising:

a combustion chamber disposed about an axis and having first and second axial ends and radially inner and outer walls; and groups of injectors disposed about the axis at the first axial end for introducing a hydrogen and gas mixture into radially inner, outer, and intermediate mixing regions in the combustion chamber, each of the groups including radially inner, outer, and intermediate injectors, each of the injectors having an injector body, an air feed conduit and a hydrogen feed conduit that both extend through the injector body and open at one of the radially inner, outer, or intermediate mixing regions, the hydrogen fed conduit including an open-cell metallic foam disposed therein, the combustion chamber including first and second conical fairings radially between, respectively, the inner and intermediate injectors and the outer and intermediate injectors, the first and second conical fairings bounding radial portions of each of the radially inner, outer, and intermediate mixing regions wherein the first conical fairing extends between the injector bodies of the inner and intermediate injectors and the second conical fairing extends between injector bodies of the outer and intermediate injectors and the air feed conduits extend through the injector bodies at bases of either the first and second conical fairings.

2. The gas turbine engine as recited in claim 1, wherein the intermediate injector is a pilot injector for introducing a first percentage of the hydrogen and gas mixture into the combustion chamber.

3. The gas turbine engine as recited in claim 2, wherein the radially inner and outer injectors are main injectors for introducing a second percentage of the hydrogen and gas mixture into the combustion chamber.

4. The gas turbine engine as recited in claim 1, wherein the first and second conical fairings include cooling jets.

5. The gas turbine engine as recited in claim 1, wherein the groups include pilot groups in which the injectors are pilot injectors for introducing a first percentage of the hydrogen and gas mixture into the combustion chamber.

6. The gas turbine engine as recited in claim 5, wherein the groups include main groups in which the injectors are main injectors for introducing a second percentage of the hydrogen and gas mixture into the combustion chamber.

7. The gas turbine engine as recited in claim 6, wherein the pilot groups and the main groups circumferentially alternate such that each of the pilot groups is circumferentially between two of the main groups and each of the main groups is circumferentially between two of the pilot groups.

8. The gas turbine engine as recited in claim 7, wherein the pilot groups each have a first arc length about the axis, the main groups each have a second arc length about the axis, and the first arc length is different than the second arc length.

9. A gas turbine engine comprising:

a combustor section having a combustion chamber disposed about an axis and having first and second axial ends and radially inner and outer walls;

a hydrogen source; and groups of injectors disposed about the axis at the first axial end and oriented to introduce, when the gas turbine engine is in use, a mixture of hydrogen from the hydrogen source and gas into radially inner, outer, and intermediate mixing regions in the combustion chamber, each of the groups including radially inner, outer, and intermediate injectors, each of the injectors having an injector body an air feed conduit and a hydrogen feed conduit and a hydrogen feed conduit that both extend through the injector body and open at one of the radially inner, outer, or intermediate mixing regions, the hydrogen fed conduit including an open-cell metallic foam disposed therein, the combustion chamber including first and second conical fairings radially between, respectively, the inner and intermediate injectors and the outer and intermediate injectors, the first and second conical fairings bounding radial portions of each of the radially inner, outer, and intermediate mixing regions wherein the first conical fairing extends between the injector bodies of the inner and intermediate injectors and the second conical fairing extends between injector bodies of the outer and intermediate injectors and the air feed conduits extend through the injector bodies at bases of either the first and second conical fairings.

10. The gas turbine engine as recited in claim 9, wherein the groups of injectors introduce 70% to 80% of the gas for combustion into the combustion chamber, the combustion chamber includes cooling jets, and the cooling jets introduce 10% to 20% of the gas for combustion into the combustion chamber.

11. The gas turbine engine as recited in claim 10, wherein the intermediate injector is a pilot injector for introducing a first percentage of the hydrogen and air mixture into the combustion chamber, and the radially inner and outer injectors are main injectors for introducing a second percentage of the hydrogen and gas mixture into the combustion chamber.

12. The gas turbine engine as recited in claim 9, wherein the first and second conical fairings include cooling jets.

13. The gas turbine engine as recited in claim 9, wherein the groups include pilot groups in which the injectors are pilot injectors for introducing a first percentage of the hydrogen and gas mixture into the combustion chamber.

14. The gas turbine engine as recited in claim 13, wherein the groups include main groups in which the injectors are main injectors for introducing a second percentage of the hydrogen and gas mixture into the combustion chamber.

15. The gas turbine engine as recited in claim 14, wherein the pilot groups and the main groups circumferentially alternate such that each of the pilot groups is circumferentially between two of the main groups and each of the main groups is circumferentially between two of the pilot groups.

16. The gas turbine engine as recited in claim 15, wherein the pilot groups each have a first arc length about the axis, the main groups each have a second arc length about the axis, and the first arc length is different than the second arc length.

17. The gas turbine engine as recited in claim 1, wherein the first conical fairing bounds a radially inner portion of the radially intermediate mixing region, and the second conical fairing bounds a radially outer portion of the radially intermediate mixing region.

* * * * *